US009192971B2

(12) United States Patent
Odom

(10) Patent No.: US 9,192,971 B2
(45) Date of Patent: Nov. 24, 2015

(54) PORTABLE TOOL FOR STRAIGHTENING METAL

(71) Applicant: Thomas A. Odom, Darlington, SC (US)

(72) Inventor: Thomas A. Odom, Darlington, SC (US)

( * ) Notice: Subject to any disclaimer, the term of this patent is extended or adjusted under 35 U.S.C. 154(b) by 129 days.

(21) Appl. No.: 14/099,001

(22) Filed: Dec. 6, 2013

(65) Prior Publication Data

US 2015/0158069 A1 Jun. 11, 2015

(51) Int. Cl.
*B21D 1/10* (2006.01)
*B21D 3/00* (2006.01)

(52) U.S. Cl.
CPC ... *B21D 1/10* (2013.01); *B21D 3/00* (2013.01)

(58) Field of Classification Search
CPC ..... B21D 1/10; B21D 1/14; B21D 3/00
USPC ..... 72/470
See application file for complete search history.

(56) References Cited

U.S. PATENT DOCUMENTS

| | | | | | |
|---|---|---|---|---|---|
| 2,794,355 | A * | 6/1957 | Geller | 72/458 |
| 2,844,060 | A | 7/1958 | Hagerty et al. | |
| 2,922,326 | A | 1/1960 | Martin | |
| 3,546,919 | A | 12/1970 | Fial | |
| 3,611,784 | A * | 10/1971 | Prichard | 72/458 |
| 3,808,873 | A * | 5/1974 | Santhony | 72/479 |
| 4,399,677 | A | 8/1983 | Price, III et al. | |
| 4,541,267 | A | 9/1985 | Kapphahn | |
| 4,719,781 | A | 1/1988 | Cloup | |
| 5,348,459 | A | 9/1994 | Sauron et al. | |
| 6,237,391 | B1 * | 5/2001 | Beckett | 72/476 |
| 8,091,403 | B2 * | 1/2012 | Woulds | 72/481.7 |

* cited by examiner

*Primary Examiner* — David B Jones
(74) *Attorney, Agent, or Firm* — P. Jeff Martin; The Law Firm of P. Jeffrey Martin, LLC

(57) ABSTRACT

A portable tool for straightening the mower deck of a lawn mower, the tool includes an elongated handle and a pair of circular plates between which the mower deck body metal is fixedly held which creates a fulcrum about which the handle or lever is pivoted, and thereby allows user to straighten the mower deck body.

13 Claims, 7 Drawing Sheets

PORTABLE TOOL FOR STRAIGHTENING METAL

RELATED APPLICATIONS

There are no previously filed, nor currently any co-pending applications, anywhere in the world.

BACKGROUND OF THE INVENTION

1. Field of the Invention

The present invention relates generally to tools and implements, and more particularly, to an improved tool for straightening the mower deck of a lawn mower.

2. Description of the Related Art

Lawn mower machines are well known in the art for cutting grass and weeds. However, during use, lawn mowers oftentimes come into contact with roots, stumps, bricks, stones, water meters, or other obstructions which bends the mower deck and/or blades. Conventionally, in order to repair the damaged mower deck and blades, the user is required to replace the damaged parts with new parts.

The prior art has failed to disclose or teach a portable tool for straightening the mower deck and aligning blades of a lawn mower, and which can be performed without removing the deck from the mower.

Accordingly, a need exists for an improved tool for straightening the mower deck and aligning mower blades of a lawn mower. The development of the portable tool for straightening metal fulfills this need.

A search of the prior art did not disclose any patents that read directly on the claims of the instant invention; however, the following references were considered related:

U.S. Pat. No. 4,541,267, issued in the name of Kapphahn;
U.S. Pat. No. 2,844,060, issued in the name of Hagerty et al.;
U.S. Pat. No. 2,922,326, issued in the name of Martin;
U.S. Pat. No. 4,719,781, issued in the name of Cloup;
U.S. Pat. No. 4,399,677, issued in the name of Price, III et al.;
U.S. Pat. No. 3,546,919, issued in the name of Fial; and
U.S. Pat. No. 5,348,459, issued in the name of Sauron et al.

This application presents claims and embodiments that fulfill a need or needs not yet satisfied by the products, inventions and methods previously or presently available. In particular, the claims and embodiments disclosed herein describe a portable tool for straightening the mower deck body metal and aligning blades of a lawn mower, the tool comprising an elongated rod and a pair of rigid plates; a lever extension slidably engaged over the rod; and a mounting means for detachably securing the tool to a spindle receiver of the mower deck, the portable tool providing unanticipated and nonobvious combination of features distinguished from the products, inventions and methods preexisting in the art. The applicant is unaware of any product, method, disclosure or reference that discloses the features of the claims and embodiments disclosed herein.

SUMMARY OF THE INVENTION

Briefly described according to one embodiment of the present invention, a portable tool for straightening the mower deck of a lawn mower is disclosed. The portable tool is adapted and configured to be detachably mounted to the spindle pocket of the mower deck of a lawn mower via a plurality of fasteners or couplings. The tool comprises an elongated rod and a pair of rigid plates, the pair of plates comprising a lower plate and an upper plate. The lower end of the rod is securably mounted perpendicularly to the central upper surface of the lower plate. The lower plate includes a series of spaced holes defined perpendicularly therethrough and oriented thereabout for mutual axial alignment with holes defined through the spindle pocket.

The upper plate includes a central, circular opening through which the upper plate is slidably engaged by the rod for vertical translation thereabout. The upper plate further includes a series of complementary spaced holes defined perpendicularly therethrough and oriented thereabout for mutual axial alignment with both the holes of the spindle pocket and the lower plate.

To repair a bent spindle pocket of a mower deck, the tool of the present invention is mounted to the spindle pocket in a manner such that the spindle pocket is sandwiched between the upper and lower plates. In such configuration, the upper plate and the lower plate create a fulcrum about which the rod or lever may be pivoted. The rod is pivoted in a direction being against the deck metal disposition. Taken from the perspective the dent projects upwardly from the upper surface of the mower deck (e.g., the dent is raised), the rod is pivoted angularly downward against the disposition.

In order to increase leverage of the portable tool, a lever extension is disclosed, wherein the lever extension comprises an elongated, rigid cylinder slidably received by the rod in a snug-fit manner. The lever extension imparts substantially increased mechanical advantage to the user.

In accordance to one embodiment, the lever extension is telescopically adjustable so as to allow for a plurality of selectively-desired, longitudinal setting positions thereof. The telescopic handle comprises a first elongated cylinder telescopically engageable with a second elongated cylinder. The elongated cylinders are adjustably lockable at a desired longitudinal position or setting via a conventional locking device.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Figure 1:
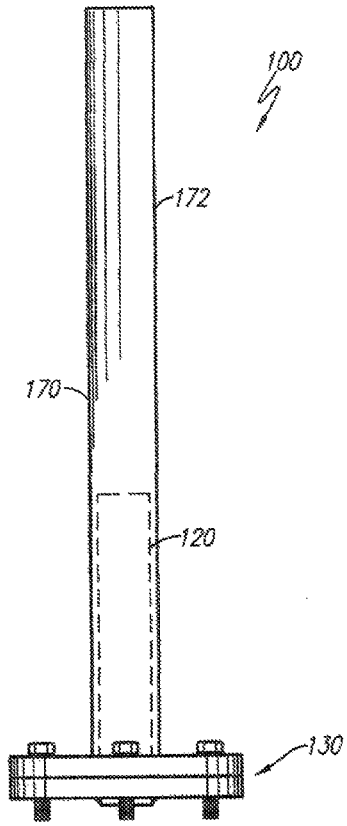
FIG. 1 is a side elevational view of a portable tool for straightening a mower deck, according to one embodiment of the present invention.
Figure 8:
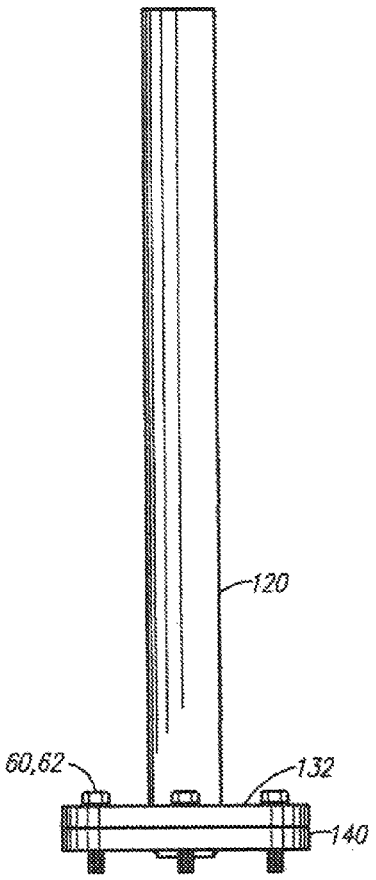
FIG. 8 is a side elevational view of a tool for straightening a mower deck, in accordance to one embodiment of the present invention.
Figure 7:
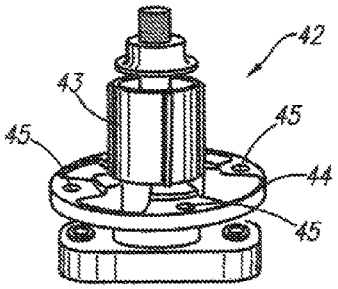
FIG. 7 is a side elevational view of an exemplary spindle.
Figure 10:
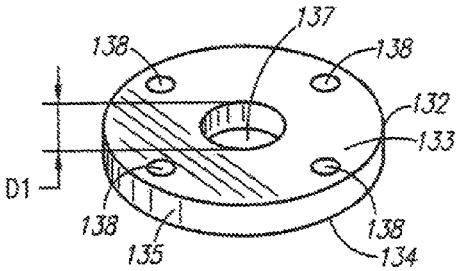
FIG. 10 is a top perspective view illustrating the upper plate of the tool of the present invention, in accordance to one embodiment thereof.

Referring now to FIGS. 1 and 8, a portable tool for straightening a mower deck is shown, according to one embodiment of the present invention. More particularly, the tool for straightening a mower deck, hereinafter "tool 100" is adapted and configured to straighten a mower deck, and align mower blades of machines used for cutting grass lawns, weeds, light brush, and similar applications, wherein such machines being more commonly referred to as lawn mowers 10.

Figure 2:
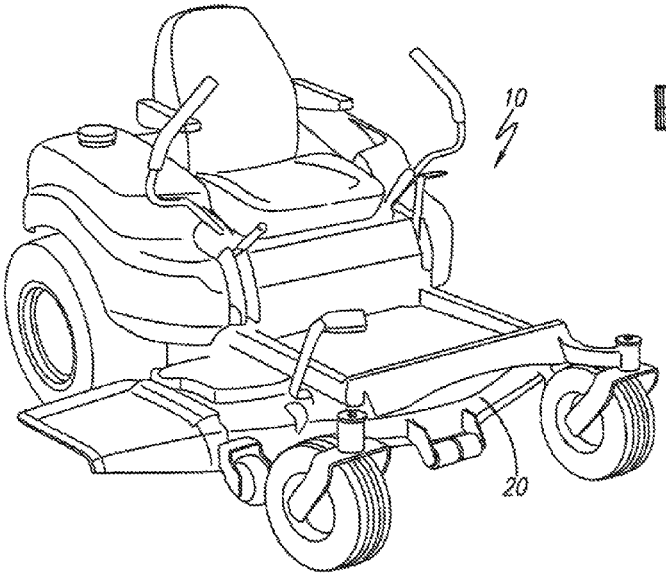
FIG. 2 illustrates a conventional lawn mower.
Figure 3:
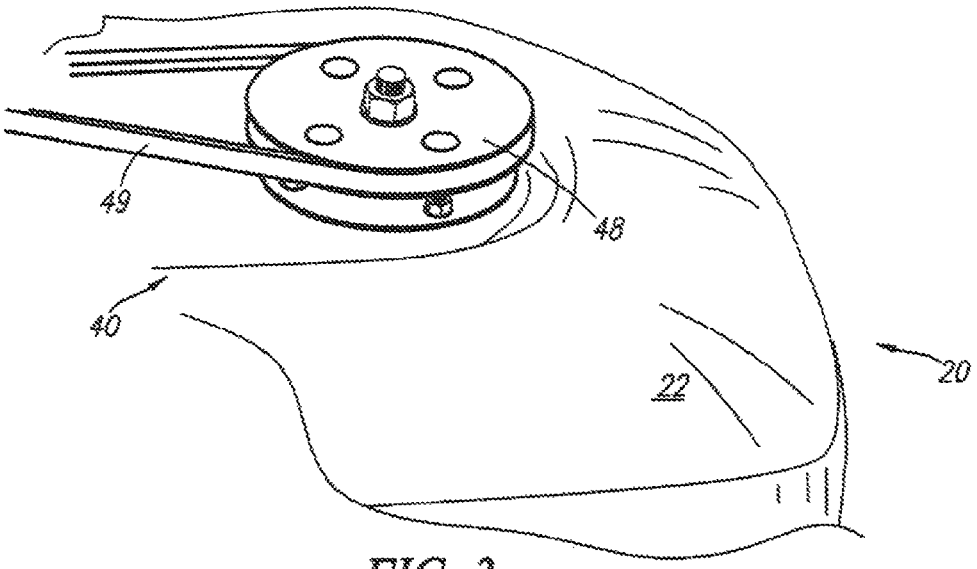
FIG. 3 is a partial, top right perspective view of a mower deck illustrating a spindle assembly of a lawn mower.
Figure 4:
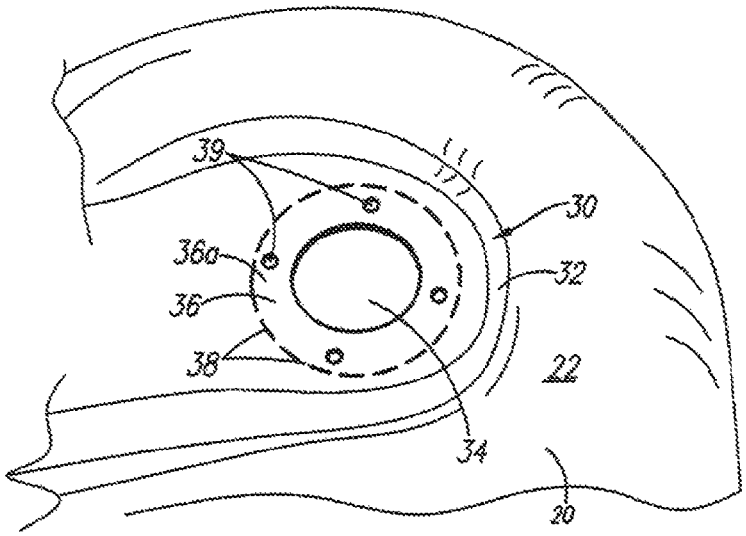
FIG. 4 is a partial top perspective view of a mower deck illustrating a spindle receiver thereof.
Figure 5:
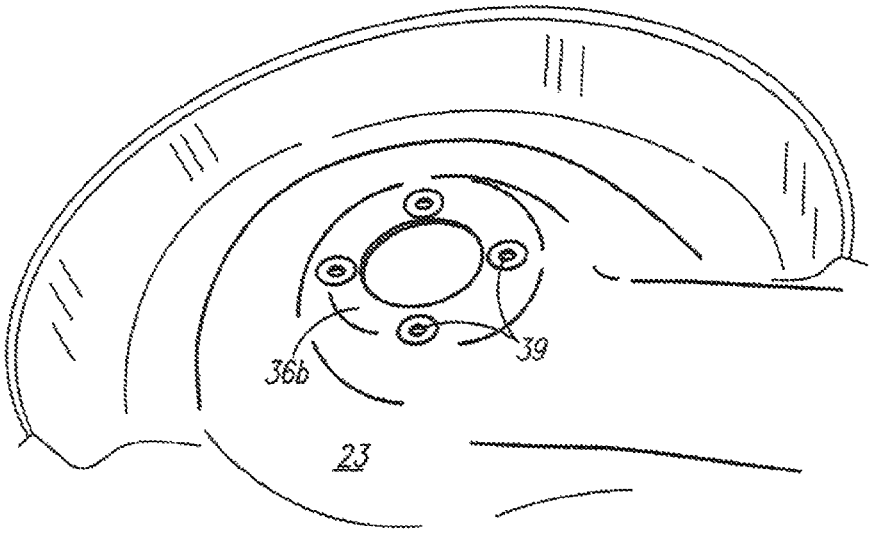
FIG. 5 is a partial bottom perspective view of the mower deck of FIG. 4, illustrating the spindle receiver.

Typically, the largest group of machines used for cutting grass, weeds, brush, and the like includes reel-type mowers, rotary mowers, and sickle mowers. The lawn mower 10 shown in FIG. 2 illustrates a rotary mower. Rotary mowers are the market volume leaders in lawn cutting equipment.

In reference to FIGS. 2-7, the lawn mower 10 includes a mower deck 20 and one or more spindle assemblies 40. The mower deck 20 includes an upper surface 22 and a lower surface 23. The mower deck 20 further includes one or more spindle receivers 30 formed integral therein, wherein the number of spindle receivers 30 being equal to the number of spindle assemblies 40. The spindle receiver 30 comprises a circular, recessed cavity or pocket 32 integrally formed along the upper surface of the deck 20. The pocket 32 includes a circular opening 34 about a center of the pocket 32, the opening 34 includes a mouth 36 defined as the concentric surface area between the spaced lines 38 and the circular opening 34. The mouth 36 includes an upper surface 36*a* opposing a lower surface 36*b*. A series of spaced holes 39 are defined perpendicularly through the mouth 36.

Figure 6:
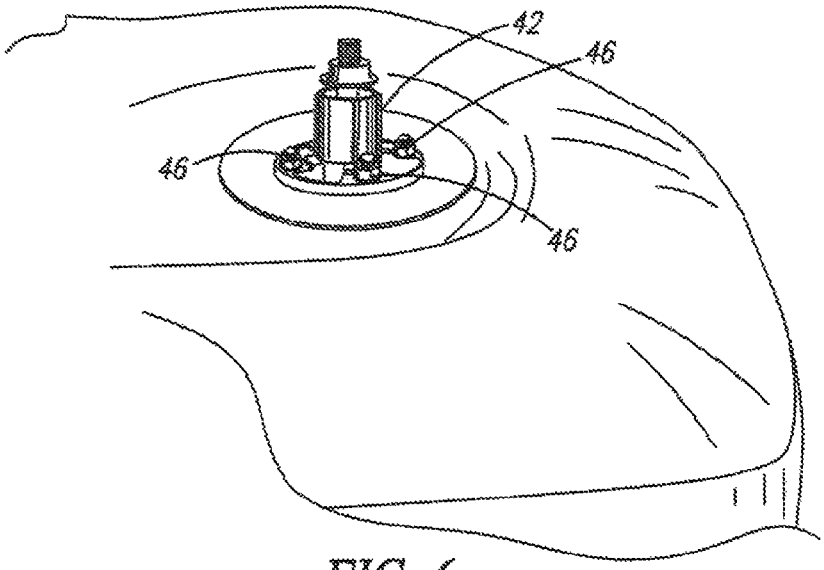
FIG. 6 is a partial, top right perspective view of a mower deck illustrating a spindle mounted to the spindle pocket of the mower deck.

The spindle assembly 40 comprises a spindle 42 to which a pulley 48 is secured to the upper end thereof. A belt 49 is looped around the pulley 48. The spindle 42 includes a spindle shaft 43 having a collar 44 extending outward radially therefrom. The collar 44 includes a series of spaced holes 45 defined perpendicularly therethrough and oriented thereabout for mutual alignment with the holes 39 of the mouth 36 of spindle pocket 32. The spindle 42 is mounted via a coupling 46 (such as nuts and bolts) atop the mouth 36 of spindle pocket 32, as shown in FIG. 6.

Figure 9:
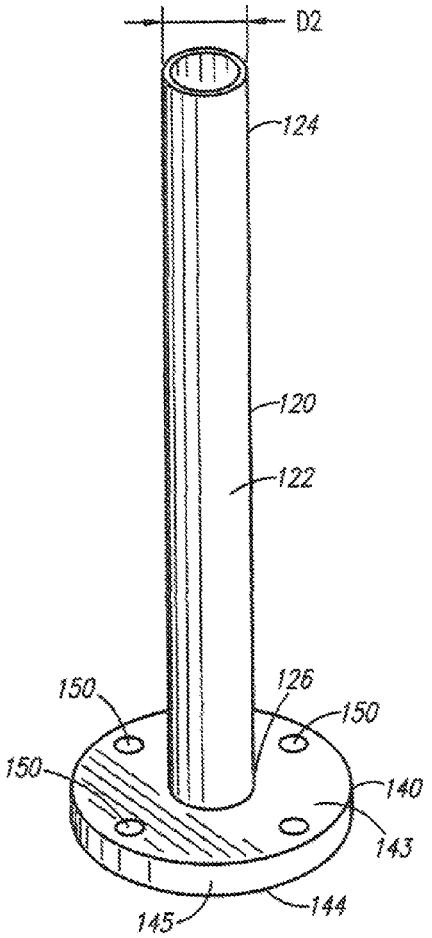
FIG. 9 is a side perspective view illustrating the rod and lower plate of the tool of the present invention, in accordance to one embodiment thereof.
Figure 9A:
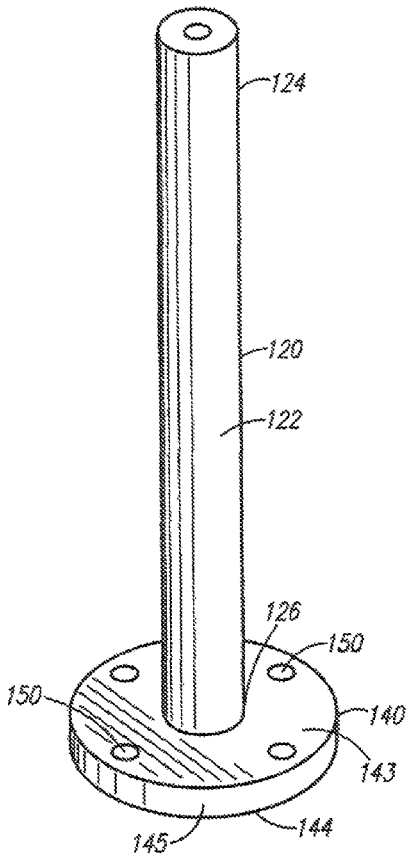
FIG. 9A is a side perspective view illustrating the rod and lower plate of the tool of the present invention, in accordance to an alternate embodiment thereof.

Referring now more specifically to FIGS. 1, and 8-10, the tool 100 is adapted and configured to be detachably mounted to the spindle receiver 30 of a mower deck 20 of a lawn mower 10 via a suitable coupling assembly 60, such as bolts 62, nuts and washers, and the like. The tool 100 comprises an elongated rod 120 and a pair of rigid plates 130. The rod 120 comprises an elongated body 122 having an upper end 124 and a lower end 126. The rod 20 is preferably solid, but may also be cylindrical, as shown in FIG. 9A. The pair of plates 130 comprises an upper plate 132 and a lower plate 140. The upper plate 132 and lower plate 140 each defines a circular, disc-shaped configuration. While the upper and lower plates 132 and 140 may be constructed into other geometric shapes, such as including, but not limited to oblong and oval, circular is preferred so as to limit stress imparted to the metal from which the mower deck is constructed during use of the tool 100, as will be described later in greater detail.

The elongated rod 120 is constructed of a strong, durable load bearing material, preferably a high grade steel composition, or steel alloy. Alternatively, the rod 120 may be constructed of a strong, rigid and durable load bearing material selected from the group comprising a plastic polymer, thermoplastic, or a metallic-plastic composite. In the event the fabrication material for constructing the rod 120 is selected from the group which includes a plastic polymer, thermoplastic, or metallic-plastic composite, the rod 120 may fabricated utilizing a common molding process such as injection molding, blow molding, extrusion, or other molding and fabricating methods.

The elongated rod 120 may comprise a length measuring approximately between 4.0 inches to 16.0 inches, preferably between 8.0 inches to 12.0 inches, and most preferably 10.0 inches.

The lower plate 140 includes an upper surface 143, a lower surface 144, and an upwardly projecting sidewall 145 integrally joining the upper surface 143 and lower surface 144, the sidewall 145 forming a circular perimeter around the lower plate 140. The lower end 126 of the rod 120 is securably mounted, such as by arc welding, perpendicularly to the upper surface 143 of the lower plate 140 about a center thereof.

The lower plate 140 further includes a series of spaced holes 150 defined perpendicularly therethrough, proximal to upwardly projecting sidewall 145, the holes 150 being oriented about the lower plate 140 so as to allow for mutual axial alignment by holes 150 with the holes 39 of the mouth 36 of spindle pocket 32. The lower plate 140 may comprise a diameter measuring approximately between 1.5 inches to 8.5 inches, preferably between 3.5 inches to 6.5 inches, and most preferably 5.0 inches.

The upper plate 132 includes an upper surface 133, a lower surface 134, and an upwardly projecting sidewall 135 integrally joining the upper surface 133 and lower surface 134, the sidewall 135 forming a circular perimeter around the upper plate 132. The upper plate 132 further includes an enlarged central, circular opening 137, the enlarged central, circular opening 137 has a diameter D1 measuring greater than a diameter D2 of the rod 120, thereby allowing the upper plate 132 to be slidably engaged by the rod 120 for vertical translation thereabout.

The upper plate 132 further includes a series of complementary spaced holes 138 defined perpendicularly therethrough, proximal to upwardly projecting sidewall 135, the holes 138 being oriented about the upper plate 132 so as to allow for mutual axial alignment by the holes 138 with both the spaced holes 150 of lower plate 140 and with the holes 39 of the mouth 36 of spindle pocket 32.

The upper plate 132 and lower plate 140 are each constructed of a strong, durable load bearing material, preferably a high grade steel composition, or steel alloy. Alternatively, the upper plate 132 and lower plate 140 may each be constructed of a strong, rigid and durable load bearing material selected from the group comprising a plastic polymer, thermoplastic, or a metallic-plastic composite. In the event the fabrication material for constructing the upper plate 132 and lower plate 140 is selected from the group which includes a plastic polymer, thermoplastic, or metallic-plastic composite, the upper plate 132 and lower plate 140 may each be fabricated utilizing a common molding process such as injection molding, blow molding, extrusion, or other molding and fabricating methods. In accordance to an embodiment wherein the elongated rod 120 and lower plate 140 are each constructed of a material selected from the group comprising a plastic polymer, thermoplastic, or a metallic-plastic composite, the lower end 126 of the rod 120 may be molded integral perpendicularly to the upper surface 143 of the lower plate 140 about a center thereof, using a previously-described molding process, thereby providing a one-piece unitary structure. The word "unitary", as used herein, is defined as a continuous, homogeneous mass formed by a single injection of polymer, thermoplastic, or a metallic-plastic material, or polymer, thermoplastic, or a metallic-plastic resin material.

Figure 11:
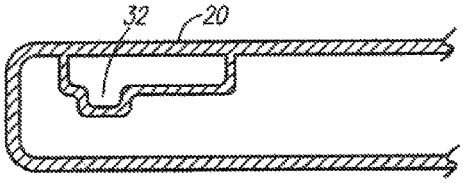
FIG. 11 is a partial, left side cross-sectional view of a mower deck, wherein the spindle pocket thereof is illustrated in an original condition.
Figure 12:
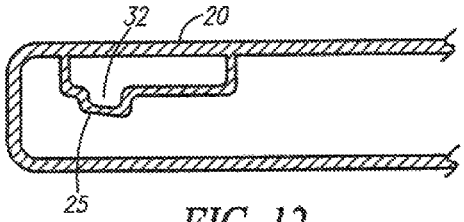
FIG. 12 is a partial, left side cross-sectional view of a mower deck, wherein the spindle pocket thereof has a bent portion.

In reference to FIG. 11, a partial, left side cross-sectional view of a mower deck 20, wherein the spindle pocket 32 thereof is illustrated in an original condition. In contrast, FIG. 12 is a partial, left side cross-sectional view of a mower deck 20, wherein the spindle pocket 32 thereof has a bent portion 25 or dented portion.

Referring now more specifically to FIGS. 1-13, in order to straighten a bent mower deck 20 of a lawn mower 10, and particularly the spindle pocket 32 thereof (such as the pocket 32 shown in FIG. 12), first, the mower deck 20 is removed from the mower 10. Next, the spindle assembly 40, more particularly the spindle 42, pulley 48, and belt 49 are detached from the spindle pocket 32. Next, from the lower surface 23 side of mower deck 20, the upper end 124 of the rod 120 is inserted through the circular opening 34 of spindle pocket 32 and pulled until the upper surface 143 of the lower plate 140 intimately engages the lower surface **36*b* of the mouth 36 of the opening 34 of spindle pocket 32. The upper plate 132 is then slidably positioned onto the rod 120 by passing the rod 120 through the enlarged central, circular opening 137 of upper plate 132 until the lower surface 134 of the upper plate 132 contacts the upper surface 36*a* of the mouth 36 of the opening 34 of spindle pocket 32. Next, the spaced holes 150 of the lower plate 140 are mutually aligned with the holes 39 of the mouth 36 of spindle pocket 32, and the complementary spaced holes 138 of the upper plate 132 are mutually aligned with the spaced holes 150 of lower plate 140 and with the holes 39 of the mouth 36 of spindle pocket 32. The tool 100 is then mounted to the spindle pocket 32 via a plurality of couplings 60, such as bolts, which are engaged through the complementary spaced holes 138 of the upper plate 132, through the holes 39 of mouth 36, and through the spaced holes 150 of lower plate 140**.

Figure 13:
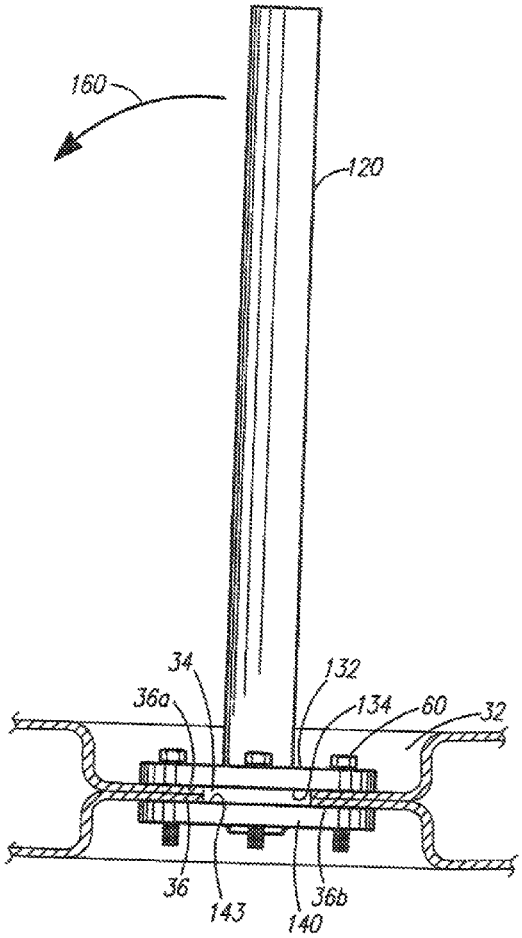
FIG. 13 is a partial cross-sectional view of a mower deck illustrating the tool of the present invention mounted to the spindle pocket of the mower deck, in accordance to one embodiment of the present invention.

Once mounted to the spindle pocket 32, the upper plate 132 and the lower plate 140 create a fulcrum about which the rod 120 or lever may be pivoted. The spindle pocket 32 is sandwiched between the upper and lower plates 132, 140. According to an exemplary implementation, in the event user desired to straighten the bent portion 25 of the mower deck 20 shown in FIG. 12, the tool 100 is mounted to the spindle pocket 32 as previously described and particularly as shown in FIG. 13. Once the tool 100 is properly mounted, user pulls/pushes the rod 120 at an angularly vertical direction equally opposite to or against the deck metal disposition, or otherwise current orientation at which the bent portion 25 has deviated from its original orientation. Thus, in order to straighten the bent portion 25 of the spindle pocket 32 of the exemplary mower deck 20 shown in FIG. 12, the user pulls the rod 120 at an angularly downward direction, as indicated by direction arrow 160 (FIG. 13), thereby applying an angularly-downward force to the bent portion 25 until the bent portion 25 is straightened or returned to an originally-shaped condition.

Further, as previously described, the upper plate 132 and the lower plate 140 create a fulcrum about which the rod 120 or lever may be pivoted. The surface area provided by the lower surface 134 of upper plate 132 and the upper surface 143 of lower plate 140 when in contact against the mouth 36 of the spindle pocket 32 during a metal deck 20 straightening event is critical to the present invention. The surface area afforded by the surfaces 134 and 143 of the upper plate 132 and lower plate 140, respectively, allows user to apply a force to a bent portion 25, wherein such force is uniformly distributed over a surface of the mower deck 20 to prevent sharp stress points or force lines which could cause the metal of the mower deck 20 to fracture.

Figure 14:
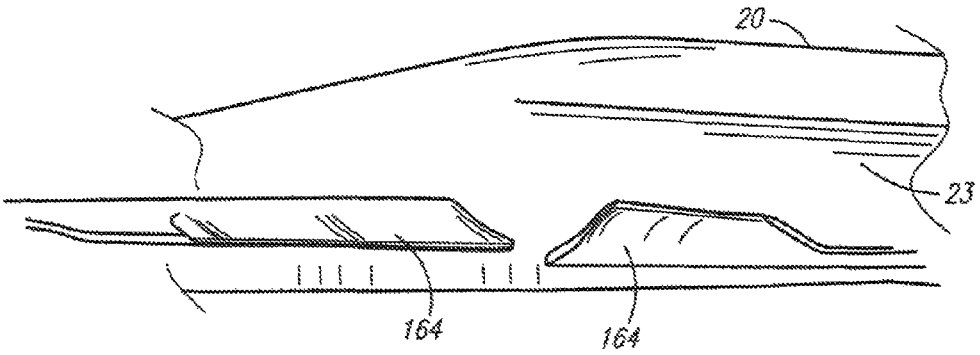
FIG. 14 is a partial side perspective view of a pair of misaligned mower blades, shown from below the mower deck.
Figure 15:
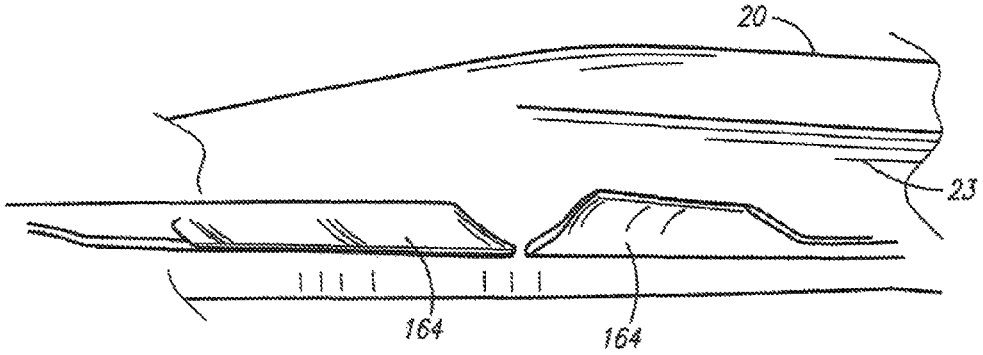
FIG. 15 is a partial side perspective view of the pair of mower blades of FIG. 14 shown realigned to an original blades alignment condition.

Referring now to FIGS. 14-15, the mower deck 20 also supports mower blades 164, blade mounts for mounting the mower blades 164, as well as pulleys and belts that drive the blades 164. Importantly, bending of the mower deck 20 most often results in misalignment of the mower blades 164. The degree of misalignment of the blades 164 is also directly relative to the degree of the disposition of the bent portion 25 of the mower deck 20, as when measured from an original condition of the mower deck 20.

The tool 100 of the present invention imparts additional unanticipated and nonobvious functional advantages and features. The tool 100 is further adapted and configured to straighten the mower deck 20 and align the mower blades 164 in a concurrent or otherwise simultaneously-conjunctive manner. Thus, as the user manipulates the tool 100 to straighten a bent portion 25, the mower blades 164 are concurrently realigned to an original blades alignment condition.

Figure 16:
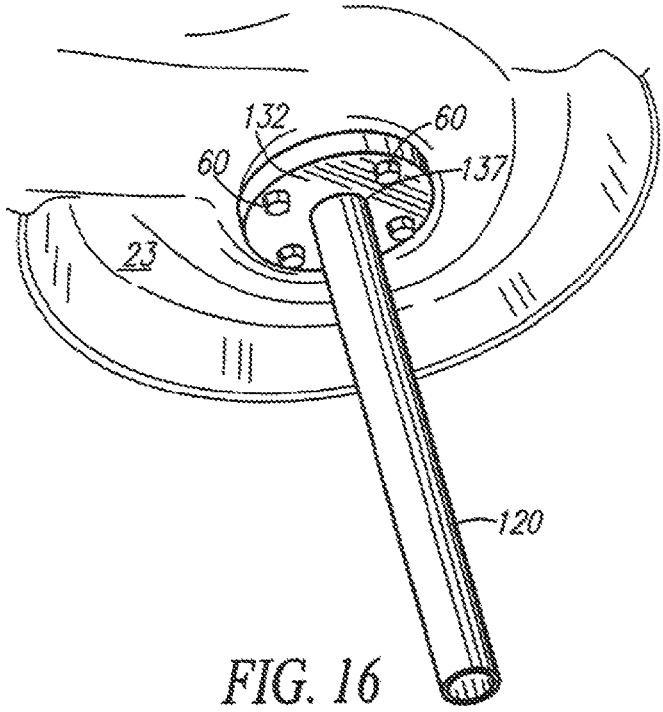
FIG. 16 is a partial bottom perspective view of a mower deck, wherein the tool of the present invention is shown mounted to the spindle pocket, according to an exemplary implementation.

In particular reference to FIG. 16, in order to straighten a bent portion 25 of a mower deck 20 without removing the deck 20 from the lawn mower 10, the mower 10 is raised or hoisted via a lift system (not shown). While suspended elevationally, the tool 100 is mounted to the spindle pocket 32 in the reverse order from the steps as previously described hereinabove. More specifically, from the upper surface 22 side of mower deck 20, the upper end 124 of the rod 120 is inserted through the circular opening 34 of spindle pocket 32 and pulled until the upper surface 143 of the lower plate 140 intimately engages the upper surface **36*a* of the mouth 36 of the opening 34 of spindle pocket 32. The upper plate 132 is then slidably positioned onto the rod 120 by passing the rod 120 through the enlarged central, circular opening 137 of upper plate 132 until the lower surface 134 of the upper plate 132 contacts the lower surface 36*b* of the mouth 36 of the opening 34 of spindle pocket 32. Next, the spaced holes 150 of the lower plate 140 are mutually aligned with the holes 39 of the mouth 36 of spindle pocket 32, and the complementary spaced holes 138 of the upper plate 132 are mutually aligned with the spaced holes 150 of lower plate 140 and with the holes 39 of the mouth 36 of spindle pocket 32. The tool 100 is then mounted to the spindle pocket 32 via a plurality of couplings 60, such as bolts, which are engaged through the complementary spaced holes 138 of the upper plate 132, through the holes 39 of mouth 36, and through the spaced holes 150 of lower plate 140**.

Referring now to FIG. 1, in order to increase leverage of the tool 100, a lever extension 170 is disclosed, wherein the lever extension 170 comprises an elongated, rigid cylinder 172 slidably received by the rod 120 in a snug-fit manner. The lever extension 170 imparts substantially increased mechanical advantage to the user. The cylinder 172 is constructed of a strong, durable load bearing material, preferably a metal material, such as steel. It is envisioned the cylinder 172 may also be constructed of other materials characterized as possessing strong, rigid and durable load bearing characteristics, and being suitable for functioning as a lever when practicing the present invention for the intended purposes described herein. The lever extension 170 is envisioned to be commercially available in a variety of lengths.

Figure 17:
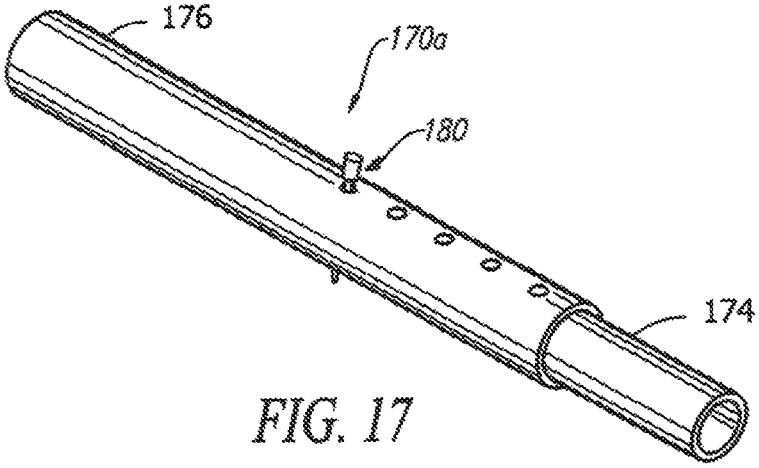
FIG. 17 is a perspective view of a lever extension, in accordance to one embodiment of the present invention.

In particular reference to FIG. 17, in accordance to one embodiment, the lever extension 170*a* is telescopically adjustable so as to allow for a plurality of selectively-desired, longitudinal setting positions thereof. The lever extension 170*a* comprises a first elongated cylinder 174 telescopically engageable with a second elongated cylinder 176. The elongated cylinders 174 and 176 are adjustably lockable at a desired longitudinal position or setting via a conventional locking device 180, such as a pin. Elongated cylinder 176 may include a series of holes defined axially through both sides thereof in corresponding relation so that pin may be utilized to secure cylinder 174 to cylinder 176 through at least one hole defined axially through both sides of elongated cylinder 174.

Finally, the tool 100 allows the user thereof to quickly and easily repair the mower deck 20 and align mower blades 164 in lieu of replacing the damaged components with new parts, thus providing a substantial cost-saving benefit to the user.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A tool for straightening metal, the tool comprising:

an elongated rod, wherein the elongated rod is solid or cylindrical;

a pair of plates, wherein the pair of plates comprises an upper plate and a lower plate, wherein a lower end of the elongated rod is securably mounted perpendicularly to the lower plate about a center of the lower plate, and wherein the upper plate is slidably engaged by the elongated rod for vertical translation about the elongated rod;

a lever extension, the lever extension is slidably received by the elongated rod; and a mounting means for detachably mounting the tool securely to a spindle receiver of a lawn mower.

2. A portable tool for straightening metal, the tool comprising:

an elongated rod, wherein the rod comprises an elongated body having an upper end and a lower end;

a pair of rigid plates, the pair of plates comprises an upper plate and a lower plate, wherein the lower plate defines a circular, disc-shaped configuration, the lower plate includes an upper surface, a lower surface, and an upwardly projecting sidewall integrally joining the upper surface and the lower surface, the upwardly projecting sidewall forming a circular perimeter around the lower plate, the lower end of the rod is securably mounted perpendicularly to the upper surface of the lower plate about a center thereof; and wherein the wherein the upper plate defines a circular, disc-shaped configuration, the upper plate includes an upper surface, a lower surface, and an upwardly projecting sidewall integrally joining the upper surface and the lower surface of the upper plate, the upwardly projecting sidewall of the upper plate forming a circular perimeter around the upper plate, the upper plate includes an enlarged central, circular opening, the enlarged central, circular opening has a diameter measuring greater than a diameter of the rod, thereby allowing the upper plate to be slidably engaged by the rod for vertical translation thereabout; and a lever extension, the lever extension is slidably received by the elongated rod.

3. The tool of claim 2, wherein the lower plate includes a series of spaced holes defined perpendicularly therethrough, proximal to the upwardly projecting sidewall, the spaced holes being oriented about the lower plate so as to allow for mutual axial alignment by the spaced holes with holes defined through a mouth of a spindle pocket of a mower deck.

4. The tool of claim 3, wherein the upper plate includes a series of complementary spaced holes defined perpendicularly therethrough, proximal to the upwardly projecting sidewall of the upper plate, the complementary spaced holes being oriented about the upper plate so as to allow for mutual axial alignment by the complementary spaced holes with both the spaced holes of the lower plate and with the holes of the mouth of the spindle pocket.

5. The tool of claim 4, wherein the upper plate and the lower plate are detachably mounted to the spindle pocket of the mower deck in a manner whereby the mouth of the spindle pocket is sandwiched between the upper plate and the lower plate.

6. The tool of claim 5, wherein the rod provides a lever, and wherein the upper plate and the lower plate creating a fulcrum about which the lever is pivotal.

7. The tool of claim 6, wherein the rod is pulled at an angularly vertical direction equally opposite to or against a bent portion of the mower deck, thereby straightening the bent portion to an originally-shaped condition.

8. The tool of claim 7, wherein the rod is slidably engaged by the lever extension, the lever extension is pulled at an angularly vertical direction equally opposite to or against a bent portion of the mower deck, thereby straightening the bent portion to an originally-shaped condition.

9. The tool of claim 8, wherein the lever extension comprises an elongated, rigid cylinder slidably received by the rod in a snug-fit manner, and wherein the lever extension is pulled at an angularly vertical direction equally opposite to or against a bent portion of the mower deck, thereby straightening the bent portion to an originally-shaped condition and aligning mower blades in a simultaneously-conjunctive manner.

10. The tool of claim 8, wherein the lever extension lever extension is telescopically adjustable so as to allow for a plurality of selectively-desired, longitudinal setting positions thereof, the lever extension comprises a first elongated cylinder telescopically engageable with a second elongated cylinder, the first elongated cylinder elongated cylinder and the second elongated cylinder are adjustably lockable at a desired longitudinal position or setting via a locking device.

11. The tool of claim 2, wherein the rod, the pair of rigid plates, and the lever extension are each constructed of a strong, durable load bearing material.

12. The tool of claim 11, wherein the strong, durable load bearing material is steel.

13. The tool of claim 2, further comprising a mounting means for detachably mounting the portable tool securely to a spindle receiver of a lawn mower.

* * * * *